US006925816B2

(12) United States Patent
Anderson et al.

(10) Patent No.: US 6,925,816 B2
(45) Date of Patent: Aug. 9, 2005

(54) COOLING A DRINKING VESSEL

(75) Inventors: Iain Wallace Anderson, Staffordshire (GB); Peter Thomas Foster, Staffordshire (GB); Stuart William Molzahn, Derbyshire (GB); Stephen Paul Smith, Derbyshire (GB); Wendy Gladys Box, Staffordshire (GB); Rachel Joanna Galt, Staffordshire (GB); David Edwin Quain, Staffordshire (GB); Alan Robert Wright, Derbyshire (GB)

(73) Assignee: Coors Worldwide Inc., Golden, CO (US)

( * ) Notice: Subject to any disclaimer, the term of this patent is extended or adjusted under 35 U.S.C. 154(b) by 0 days.

(21) Appl. No.: 10/337,036

(22) Filed: Jan. 6, 2003

(65) Prior Publication Data

US 2004/0129004 A1 Jul. 8, 2004

(51) Int. Cl.[7] ..... F25C 1/12
(52) U.S. Cl. ..... 62/74; 62/347
(58) Field of Search ..... 62/62, 64, 373

(56) References Cited

U.S. PATENT DOCUMENTS

| | | | | | |
|---|---|---|---|---|---|
| 2,749,715 | A | * | 6/1956 | Tice | 62/62 |
| 3,000,195 | A | * | 9/1961 | Federighi | 62/231 |
| 3,602,008 | A | * | 8/1971 | Kelley | 62/373 |
| 3,668,888 | A | | 6/1972 | Rosonski | 62/373 |
| 3,677,020 | A | * | 7/1972 | Munselle | 62/603 |
| 3,952,538 | A | * | 4/1976 | Warlick | 62/342 |
| 4,237,697 | A | | 12/1980 | Cherbland | 62/293 |
| 5,098,732 | A | * | 3/1992 | Inagaki | 426/565 |
| 5,367,887 | A | * | 11/1994 | Byrd et al. | 62/266 |

FOREIGN PATENT DOCUMENTS

| | | |
|---|---|---|
| GB | 2307976 | 6/1997 |
| GB | 2355060 | 4/2001 |
| WO | WO0021873 | 4/2000 |

* cited by examiner

*Primary Examiner*—William E. Tapolcai
(74) *Attorney, Agent, or Firm*—Baker Botts LLP

(57) ABSTRACT

A drinking vessel 38 in which a beverage, for example a draught beer, is to be served is cooled by formation thereon of ice formed of frozen potable liquid for example a small volume of the same beer. The potable liquid can be sprayed at 40 onto the inside 42 of the vessel 38 and/or onto the outside 44 of the vessel, and the liquid is then frozen on the vessel wall by the effect of a cooling coil 28 surrounding the vessel which can be rotated by a rotatably driven platform 30. The cooled vessel 38 will in turn cool beverage dispensed into it for drinking.

10 Claims, 2 Drawing Sheets

COOLING A DRINKING VESSEL

This invention concerns the serving of beverages and in particular the serving of cooled beverages.

According to a sixteenth aspect of the invention there is provided a method of preparing a drinking vessel to receive a beverage comprising providing a drinking vessel, introducing a potable liquid into the vessel, and cooling the potable liquid so that it freezes onto the vessel.

Preferably the vessel has a base and the liquid freezes onto the base. More preferably the vessel has sides and the liquid freezes onto the sides. The potable liquid may be directed into the vessel by means of a nozzle, for example as a spray.

Preferably the vessel is placed adjacent to heat extraction means which extracts heat from the vessel thereby to cool the potable liquid. The heat extraction means is preferably arranged to surround at least a part of the vessel. Preferably the vessel has a lower part and the heat extraction means is arranged to surround the lower part.

Preferably the vessel is rotated whilst the potable liquid is freezing. The rotating of the vessel may be arranged to displace some of the potable liquid outwards so that it has a non-level upper surface when frozen. Preferably the vessel has an axis which is arranged to be vertical if the vessel is upright, and the vessel is inclined so that the axis is non-vertical whilst the potable liquid is freezing. More preferably the vessel has a side and the liquid is poured against the side of the vessel so that it runs down the side of the vessel and freezes against it. Alternatively the vessel may be inverted and the potable liquid sprayed into the vessel.

The present invention further provides a method of serving a beverage comprising preparing a vessel according to the invention and dispensing beverage into the vessel. The beverage may be alcoholic, for example being selected from the group consisting of beer and cider and may be a draught beverage.

The potable liquid may conveniently comprise a volume of the beverage. Alternatively it may be water.

The present invention further provides a method of serving a beverage comprising introducing beverage into a vessel having a lower portion and an upper portion, and cooling the beverage so that some of the beverage freezes onto the lower portion of the vessel while some of the beverage in the upper portion remains liquid. Preferably the beverage is cooled by cooling the lower portion of the vessel more than the upper portion.

The present invention further provides a method of serving a beverage comprising introducing a volume of a potable liquid and a volume of a beverage into a drinking vessel and cooling the potable liquid such that it freezes onto the vessel. The potable liquid may be frozen before the beverage is introduced into the vessel. Alternatively the potable liquid and the beverage may be introduced into the vessel at the same time.

The present invention yet further provides apparatus for preparing a vessel to receive a beverage comprising a supply arranged to supply a volume of potable liquid into a drinking vessel, and cooling means arranged to cool the potable liquid so that it freezes onto the vessel. Preferably the apparatus is for use with a vessel having a base, and the cooling means is arranged to cool potable liquid which is in contact with base so that the potable liquid freezes onto the base. More preferably the apparatus is for use with a vessel having a side, and the cooling means is arranged to cool potable liquid which is in contact with side so that the potable liquid freezes onto the side.

Preferably the supply includes a nozzle for directing the potable liquid into the vessel. The nozzle may be arranged to direct potable liquid into the vessel as a spray.

Preferably the cooling means is arranged to extract heat from the vessel thereby to cool the potable liquid. For example the cooling means may be arranged to surround at least a part of the vessel.

Preferably the apparatus includes rotating means arranged to rotate the vessel whilst the potable liquid is freezing. More preferably the rotating means is arranged to rotate the vessel so as to displace some of the potable liquid outwards so that it has a non-level upper surface when frozen. Still more preferably the apparatus is arranged for use with a vessel having an axis which is arranged to be vertical if the vessel is upright, the apparatus being arranged to support the vessel such that it is inclined so that the axis is non-vertical whilst the potable liquid is freezing. Yet more preferably the apparatus is arranged for use with a vessel having a side, the apparatus including a nozzle arranged to dispense the potable liquid against the side of the vessel as the vessel is rotated. Alternatively the apparatus may be arranged to support the vessel in an inverted position while the potable liquid is sprayed into the vessel.

Preferably the apparatus includes a supply of beverage, the apparatus being arranged to dispense the beverage into the vessel. The supply may be arranged to supply the beverage as draught beverage. Preferably the supply is arranged to supply the potable liquid and the beverage from the same source so that the potable liquid is a volume of the beverage.

The present invention further provides apparatus for serving a beverage comprising a supply for introducing beverage into a vessel having a lower portion and an upper portion, the apparatus including cooling means arranged to cool the lower portion of the vessel so that some of the beverage freezes onto the lower portion of the vessel while some of the beverage in the upper portion remains liquid. Preferably the cooling means is arranged to cool the lower portion of the vessel more than the upper portion.

The present invention still further provides apparatus for serving a beverage comprising a supply arranged to introduce a volume of a potable liquid and a volume of a beverage into a drinking vessel and cooling means arranged to cool the potable liquid such that it freezes onto the vessel.

The present invention yet further provides apparatus for preparing a drinking vessel having a surface for receiving a volume of beverage, the apparatus comprising a supply of potable liquid arranged to direct the potable liquid onto the surface of the vessel, and cooling means arranged to produce cooling of the potable liquid so that it freezes onto the surface.

The present invention still further provides a cooled beverage presented in a drinking vessel having a side, the vessel having ice formed of frozen potable liquid on said side. Preferably the beverage presented in the vessel is similar to the potable liquid which is frozen to form said ice.

The beverage may be non-alcoholic or alcoholic. An alcoholic beverage may be a beer, for example a lager or an ale, stout or porter, or the alcoholic beverage may be cider.

Attention is drawn to two International patent applications, namely International Application No. PCT/GB99/03824 (published under No. WO01/36582) and International Application No. PCT/GB99/01551 (published under No. WO99/60092). Any individual features or any combination of such features of any beverage disclosed in either of those International applications, and any method or apparatus or part of any method or apparatus disclosed in either of those International applications may be utilised in the serving of beverage which is the subject of this current application.

The invention will now be described, by way of example, with reference to the accompanying drawings in which.

Figure 1:
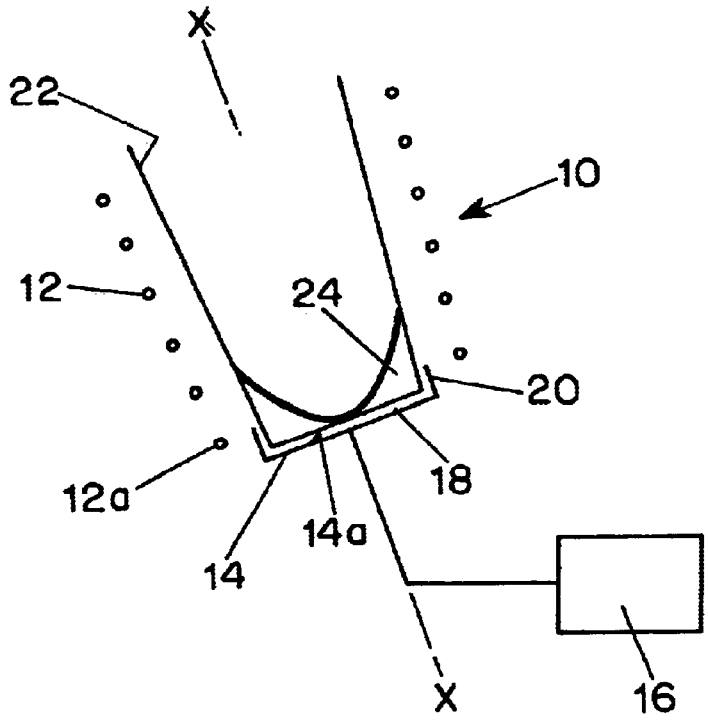
FIG. 1 shows a first embodiment of a drinking vessel cooling apparatus according to the present invention.

Referring now to FIG. 1, a drinking vessel cooling apparatus 10 includes a cooling coil 12, a platform 14 and a motor 16. The platform 14 has a circular body 18 which is rotatable about an axis X—X which passes through its centre point and is perpendicular to its top surface 14*a*. A circumferentially extending retaining wall 20 is provided around the edge of the body 18 to retain a drinking vessel, in the form of a glass 22, thereon. The platform 14 is inclined at an angle to the horizontal such that the vessel 22 is also inclined when supported on it. The cooling coil 12 is helical having a lower end 12*a* level with the platform 14 and of a wider diameter. The coil 12 is also inclined at the same angle as the platform with respect to the horizontal, for example of a bar surface.

The motor 16 is connected to the platform 14 so as to effect rotation of the platform 14, in use.

The platform 14 is adapted to receive and retain the drinking vessel 22, by frictional engagement of the wall 20 with the sides of the vessel 22. When supported on the platform 14 the vessel 22 resides substantially completely within the cooling coil 12.

In order to serve a drink, a small amount a potable liquid 24, for example 5–10% of the volume of the vessel 22, is dispensed into the vessel 22. The motor 16 is actuated and the platform 14, and hence the vessel 22, is rotated such that the liquid 24 is displaced outward and up the inside wall of the vessel 22.

The cooling coil 12 acts to chill the vessel 22, and hence also the liquid 24, as the vessel is rotated, which causes the liquid 24 to freeze to the inside wall and base of the vessel 22. When the liquid 24 has frozen it has a non-level upper surface 26 which is concave and symmetrical about the centre of the vessel 22. This is partly due to the inclined angle of the vessel during freezing, and partly due to the centrifugal effect urging the liquid outwards and up the sides of the vessel 22 as it is rotated. This increases the surface area of the frozen liquid in contact with the beverage when the beverage is put into the vessel. Beverage is then introduced into the vessel on top of the frozen liquid 24.

It will be appreciated that the vessel need not be retained on the platform by frictional engagement with a wall but can be retained by any convenient means for example clips, bands, bars or a screw thread means.

While it may be preferable to dispense the beverage into the vessel as soon as the liquid has been frozen into it, another possibility is to store the vessel with the frozen liquid in it until it is needed to serve a beverage in. For example a freezer could be stocked with a number of cooled drinking vessels such that, when required, they could be rapidly removed and filled with beverage.

Figure 2:
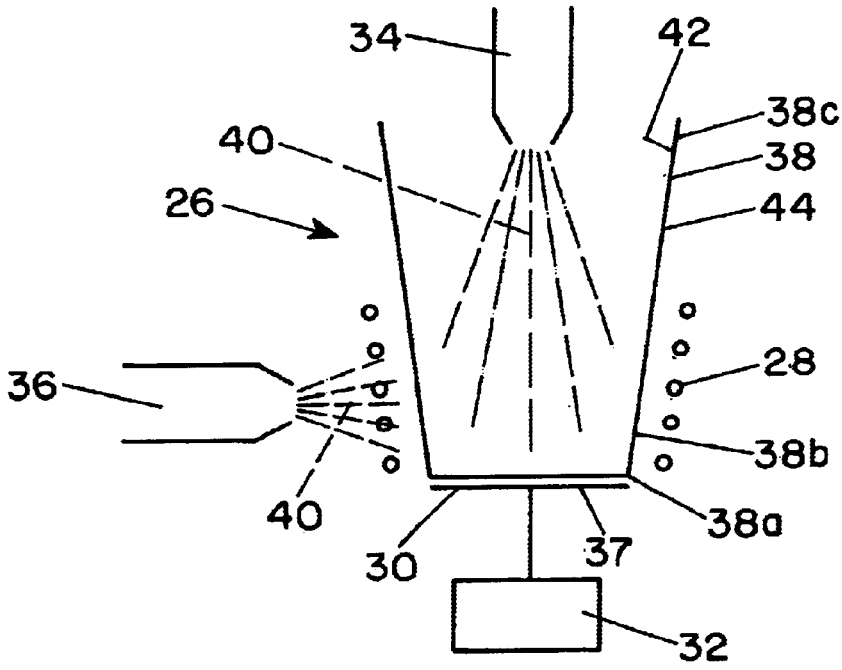
FIG. 2 shows a second embodiment of a drinking vessel cooling apparatus according to the present invention.

Referring now to FIG. 2, a drinking vessel cooling apparatus 26 according to a second embodiment of the invention includes a cooling coil 28, a platform 30, a motor 32, and first and second spray nozzles 34, 36.

The platform 30 and motor 32 are the same as those in the first embodiment except that the platform 30 is not inclined to the horizontal. A first nozzle is provided above the platform pointing downwards towards it, and is connected to a source of beverage so that it can introduce the beverage into a vessel 38 supported on the platform 30. A second nozzle 36 is provided near the platform 30, directed sideways towards the base 38*a* of the vessel 38, and is connected to a source of water so that it can spray water onto the outside of the vessel 38.

In use, the drinking vessel 38 is placed upon the platform 30 such that the lower part 38*b* of the vessel 38 lies substantially within the cooling coil 28, and the upper part 38*c* of the vessel 38 protrudes above the cooling coil 28. The motor 32 is actuated and the platform 30 rotates.

A potable liquid 40 in the form of a volume of beverage is sprayed from the nozzle 34 onto the inner surface 42 of the vessel, and a volume of potable liquid 41 is sprayed onto the outer surface 44 of the vessel 38.

The cooling coil 28 acts to chill the lower part of the vessel 38, and hence also the liquid that is in contact with that part of the vessel, and causes it to freeze upon the inner and outer surfaces 42, 44 of the vessel 38.

When the liquid has been frozen onto the vessel, a further volume of beverage is introduced, as a steady stream rather than a spray, into the vessel from the nozzle 34, and the beverage is ready to be served to a customer.

It will be appreciated that either of the nozzles 34, 36 can be omitted from the apparatus, and that the beverage forming the main volume of the drink served to the customer could be supplied from a separate nozzle, or even at a separate location such as at a conventional font. Although shown with the vessel 38 rotating any convenient arrangement in which there is relative rotational motion between the nozzles 34, 36 and the vessel 38 can be envisaged to spread the potable liquid over the surface of the vessel.

It will also be appreciated that the timing of the operation of the cooling coil 28 and the introduction of the beverage into the vessel can be varied. Either the glass 38 can be cooled first, and the beverage to be frozen onto it then added so that it freezes on contact with the glass. Alternatively the beverage can be introduced into the vessel 38 which is then cooled to cause freezing of the beverage. Obviously if the beverage is to be frozen to the sides of the vessel 38 rather than onto its base, then pre-cooling of the vessel will be required. As a further alternative the vessel can be completely filled with beverage and then the cooling coil 28 used to cool rapidly the lower part 38*b* of the vessel, without cooling the upper part 38*c*. This will cause some the beverage in the lower part 38*b* of the vessel to freeze to sides and base of the vessel, while the beverage in the upper part 38*c* of the vessel remains liquid.

The nozzle 36 may lie outside or inside the vertical extent of the cooling coil 28 and the coil 28 may have an opening to allow passage of the liquid 40 therethrough.

Figure 3:
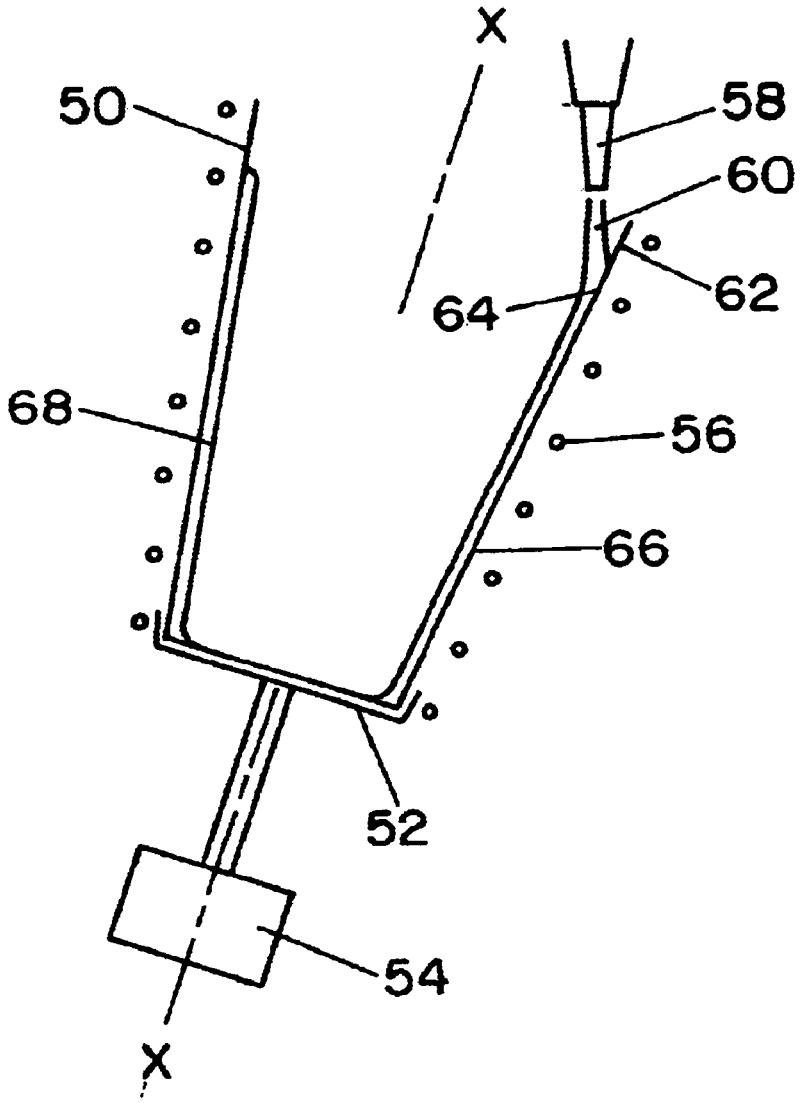
FIG. 3 shows a third embodiment of a drinking vessel cooling apparatus according to the present invention.

Referring to FIG. 3, in a third embodiment of the invention a drinking vessel in the form of a glass 50 is supported on a platform 52 which is arranged to be rotated by a motor 54. A cooling coil 56 is arranged around the position in which the glass 50 is supported so that it can cool the glass while it is on the platform 52. The platform 52 and cooling coil 56 are inclined to the horizontal so that the glass is supported at an inclined angle. A nozzle 58 is situated above the platform so that it can dispense liquid 60 against the top 62 of the inclined inner surface 64 of the side 66 of the glass 50. From there the liquid runs down the side of the glass as the glass is filled. While the liquid 60 is being dispensed into the glass, the side 66 of the glass is cooled by the cooling coil 56, and the glass is rotated about its central axis X—X which is inclined to the vertical. As the liquid runs down the side of the glass it freezes onto the glass, and, as the glass is rotated this forms a layer 68 of frozen liquid covering a substantial part of the inner surface of the glass.

When a sufficient layer of frozen liquid has built up, for example when a predetermined volume of liquid 60 has been dispensed, liquid beverage is dispensed into the glass through the nozzle 58. In this particular embodiment the liquid which is frozen onto the glass is a volume of the beverage. This ensures that, as the frozen liquid melts, the beverage will not be diluted. However it will be appreciated that a small volume of another potable liquid, such as water, could be frozen onto the glass.

It will be appreciated that in either embodiment the platforms need not be circular but can be any convenient shape to receive a vessel of complementary shape to the platform.

We claim:

1. A method of preparing a drinking vessel to receive a beverage comprising providing a drinking vessel, introducing a potable liquid into the vessel, and cooling the potable liquid so that it freezes onto the vessel wherein the vessel is rotated whilst the potable liquid is freezing and wherein the vessel has an axis which is arranged to be vertical if the vessel is upright, and the vessel is inclined so that the axis is non-vertical whilst the potable liquid is freezing and wherein the vessel has a side and the liquid is poured against the side of the vessel so that it runs down the side of the vessel and freezes against it.

2. A method of preparing a drinking vessel to receive a beverage comprising providing a drinking vessel, introducing a potable liquid into the vessel, and cooling the potable liquid so that it freezes onto the vessel wherein the vessel is inverted and the potable liquid is sprayed into the vessel.

3. Apparatus for preparing a vessel to receive a beverage comprising a supply arranged to supply a volume of potable liquid into a drinking vessel, and cooling means arranged to cool the potable liquid so that it freezes onto the vessel, said apparatus for use with a vessel having a side, wherein the cooling means is arranged to cool potable liquid which is in contact with side so that the potable liquid freezes onto the side and including rotating means arranged to rotate the vessel whilst the potable liquid is freezing for use with a vessel having an axis which is arranged to be vertical if the vessel is upright, the apparatus being arranged to support the vessel such that it is inclined so that the axis is non-vertical whilst the potable liquid is freezing and additionally for use with a vessel having a side, the apparatus including a nozzle arranged to dispense the potable liquid against the side of the vessel as the vessel is rotated.

4. Apparatus for preparing a vessel to receive a beverage comprising a supply arranged to supply a volume of potable liquid into a drinking vessel, and cooling means arranged to cool the potable liquid so that it freezes onto the vessel and wherein the supply includes a nozzle for directing the potable liquid into the vessel and wherein said nozzle is arranged to direct potable liquid into the vessel as a spray which is arranged to support the vessel in an inverted position while the potable liquid is sprayed into the vessel.

5. A beverage dispense apparatus for dispensing a beverage, the apparatus comprising a potable liquid introducing means arranged to introduce potable liquid to a vessel, a heat extraction means arranged to freeze the potable liquid to form ice on the surface of the vessel and a beverage dispense means arranged to dispense beverage into the vessel, in which said potable liquid to be frozen is directed at the vessel by nozzle means.

6. Apparatus as claimed in claim 5, in which the potable liquid is directed as a spray.

7. A beverage dispense apparatus for dispensing a beverage, the apparatus comprising a potable liquid introducing means arranged to introduce potable liquid to a vessel, a heat extraction means arranged to freeze the potable liquid to form ice on the surface of the vessel and a beverage dispense means arranged to dispense beverage into the vessel, in which the vessel is inverted and the potable liquid, to be frozen, is sprayed onto and/or into the vessel.

8. A method of preparing a drinking vessel to receive an alcoholic beverage comprising providing the drinking vessel, introducing a volume of the alcoholic beverage into the vessel, and cooling the volume of alcoholic beverage so that it freezes onto the vessel, wherein the volume of alcoholic beverage is directed into the vessel by means of a nozzle.

9. A method according to claim 8, wherein the volume of alcoholic beverage is directed into the vessel as a spray.

10. A method of preparing a drinking vessel to receive an alcoholic beverage comprising providing the drinking vessel, introducing a volume of the alcoholic beverage into the vessel, and cooling the volume of alcoholic beverage so that it freezes onto the vessel, wherein the vessel is inverted and the volume of alcoholic beverage is sprayed into the vessel.

* * * * *